US006175997B1

(12) United States Patent
Mossbeck

(10) Patent No.: US 6,175,997 B1
(45) Date of Patent: Jan. 23, 2001

(54) POCKETED COIL SPRING MATTRESS CORES

(75) Inventor: Niels S. Mossbeck, Dayton, TN (US)

(73) Assignee: L&P Property Management Company, South Gate, CA (US)

( * ) Notice: Under 35 U.S.C. 154(b), the term of this patent shall be extended for 0 days.

(21) Appl. No.: 09/024,536

(22) Filed: Feb. 17, 1998

Related U.S. Application Data

(60) Provisional application No. 60/072,155, filed on Jan. 22, 1998.

(51) Int. Cl.[7] ..... B68G 7/00

(52) U.S. Cl. ..... 29/91; 29/91.1; 29/896.92; 156/301; 156/322; 5/655.8

(58) Field of Search ..... 156/301, 320, 156/322, 324; 29/91, 91.1, 896.92; 5/655.7, 655.8

(56) References Cited

U.S. PATENT DOCUMENTS

| | | | | |
|---|---|---|---|---|
| 2,296,807 | | 9/1942 | Cavaler . | |
| 2,862,214 | | 12/1958 | Thompson et al. . | |
| 3,429,767 | * | 2/1969 | Bronstien, Jr. et al. | 156/301 X |
| 3,449,190 | * | 6/1969 | Bronstien, Jr. et al. | 156/301 X |
| 4,234,983 | | 11/1980 | Stumpf . | |
| 4,401,501 | | 8/1983 | Stumpf . | |
| 4,485,506 | | 12/1984 | Stumpf et al. . | |
| 4,566,926 | | 1/1986 | Stumpf . | |
| 4,578,834 | | 4/1986 | Stumpf . | |
| 4,907,309 | | 3/1990 | Breckle . | |
| 5,016,304 | | 5/1991 | Ryhiner . | |
| 5,016,305 | | 5/1991 | Suenens et al. . | |
| 5,273,608 | * | 12/1993 | Nath | 156/301 |
| 5,319,815 | | 6/1994 | Stumpf et al. . | |
| 5,637,178 | | 6/1997 | Suenens et al. . | |
| 5,670,001 | * | 9/1997 | Huebner et al. | 156/301 X |
| 5,851,339 | * | 12/1998 | Rucker | 156/324 |

FOREIGN PATENT DOCUMENTS

| | | |
|---|---|---|
| 4031652 | 4/1992 | (DE) . |
| 4040220 | 6/1992 | (DE) . |
| 0089789 | 9/1983 | (EP) . |
| 0357912 | 3/1990 | (EP) . |
| 1475098 | 2/1967 | (FR) . |
| 2076465 | 10/1971 | (FR) . |

OTHER PUBLICATIONS

Spuhl, Automatic Pocket Spring Assembly Machine, TFA–291.

* cited by examiner

*Primary Examiner*—P. W. Echols
(74) *Attorney, Agent, or Firm*—Wood, Herron & Evans, L.L.P.

(57) ABSTRACT

A method of assembling strings of pocketed coil springs into an innerspring core which may be used as the core of a mattress, cushion or similar body support foundation uses plastic netting reinforced nonwoven webs supplied between a pair of spaced apart heated rolls. Strings of pocketed coil springs are fed in seriatim into the nip between the rolls to heat the netting and activate an integral adhesive to bond the webs to the top and bottom surfaces of the pockets of each string. The core formed thus has reinforced webs on the top and bottom of the strings. The process overcomes the problems encountered when hot melt spraying is utilized to bond the pocketed coil strings together.

18 Claims, 2 Drawing Sheets

POCKETED COIL SPRING MATTRESS CORES

This is a continuation of U.S. Provisional Patent Application Ser. No. 60/072,155, filed Jan. 22, 1998, which is hereby incorporated by reference in its entirety.

BACKGROUND OF THE INVENTION

This invention relates to the construction of pocketed spring mattress cores and more particularly to a method of assembling pocketed coil springs into a mattress core.

It is known to place strings of pocketed coil springs in a parallel fashion to create a mattress, inner spring unit or other body support foundation. A number of coils in a string or row and the number of rows are dependent upon the coil spring diameter and the desired finished size of the mattress or the like. The construction may be a plurality of rows of parallel coils with the coils aligned in columns so that the coils line up in both longitudinal and lateral directions, or they may be nested in a honeycomb configuration wherein coils in one row are off-set from coils in the adjacent row. Moreover, the strings of coils may be separated by strips of various types of material such as polyurethane foam or other flexible materials as illustrated in Breckle et al U.S. Pat. No. 4,907,309 and German Patent No. DE 4031652. The strings of coils are commonly connected by adhesives on the sides of the coils as illustrated in Stumpf U.S. Pat. Nos. 4,566,926 and 4,578,834, and Suenens et al. U.S. Pat. Nos. 5,016,305 and 5,637,178. A nestled construction where strings of coils are interlocked are illustrated in Stumpf U.S. Pat. No. 5,319,815 and German 4,040,220. Other methods of connecting the strings of coils utilize metal clips known as hog rings or they may be stitched with twine which penetrates each string of coils.

A non-patented method in the prior art is the use of strings of coils connected by a web of nonwoven material secured by adhesive to the top and bottom of the pocketed coil units, the adhesive being applied by manually controlled or automatically controlled spray nozzles. Alternatively, or in addition, to the spraying method, beads of hot melt adhesive may be dispensed onto the top and bottom surfaces of the strings of coils or onto top and bottom sheets of nonwoven material and the sheets of nonwoven material then pressed against the adhesive top and bottom surfaces of the strings of coils.

In the prior art processes, control and distribution of the adhesive is difficult and inefficient. Some areas of the coil strings may receive too much adhesive while other areas may not receive a sufficient amount of adhesive. Excess adhesive of course is economically inefficient, while risk of separation of the pocketed coil strings from the nonwoven material may result from too little adhesive. Moreover, when adhesive is sprayed there is a tendency for the spray nozzles to clog so that the flow of glue is obstructed. This results in a time consuming cleaning and maintenance program. Additionally, hot melt spraying requires the system to be heated about one hour before spraying can begin. Other difficulties presented by hot melt spraying and application of beads is that the hoses through which the hot melt flows must be insulated to maintain the temperature of the glue within the hose, thereby resulting in very heavy hoses. Since the spraying process involves manually moving the spray nozzle to which the hose is attached to spray the adhesive, the heavy hoses result in the process being slow and fatiguing to the operators who often encounter minor burns from the glue and the nozzles.

SUMMARY OF THE INVENTION

Consequently, it is a primary object of the present invention to provide an improved method of assembling strings of pocketed coil springs into an innerspring unit for use as a core for a mattress or the like which is safe, efficient and rapid.

It is another object of the present invention to provide such a method of assembling a plurality of strings of pocketed coil springs between a pair of nonwoven webs of material, each web having a heat activated reinforcement netting.

It is a further object of the present invention to provide such a method of assembling a plurality of strings of pocketed coil springs between a pair of nonwoven webs having a netting with an integral adhesive which provides a bonding agent and reinforcement for the web.

It is a still further object of the present invention to provide such a method of assembling a plurality of strings of pocketed coil springs between a pair of netting reinforced nonwoven webs, the netting being a heat activated plastic adhesive material, the webs being supplied to and directed about a respective heated drum between which the strings of pocketed coil springs are fed so that a substantially continuous process results.

Accordingly, the present invention provides a method of assembling strings of pocketed coil springs into an innerspring core which may be used as the core of a mattress, cushion or the like. Each of the coil springs is enclosed or pocketed within a nonwoven material forming the pocket and a plurality of such pocketed coils are connected together, to form a string of such pocketed coil springs. The method preferably uses plastic netting reinforced nonwoven webs which are supplied to a pair of spaced apart heat drums or rolls which act to feed the web above and beneath strings of pocketed coil springs and act to heat the plastic and activate it as an adhesive to secure the webs to the strings of pocketed coils at the top and bottom surfaces of the material forming the pockets. Rows of strings are fed in seriatim into the nip between the spaced apart heat rolls which are driven in opposite directions to feed the webs and the strings of pocketed coils, the webs being fed with the netting facing in the direction remote from the heat roll by which it is fed.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
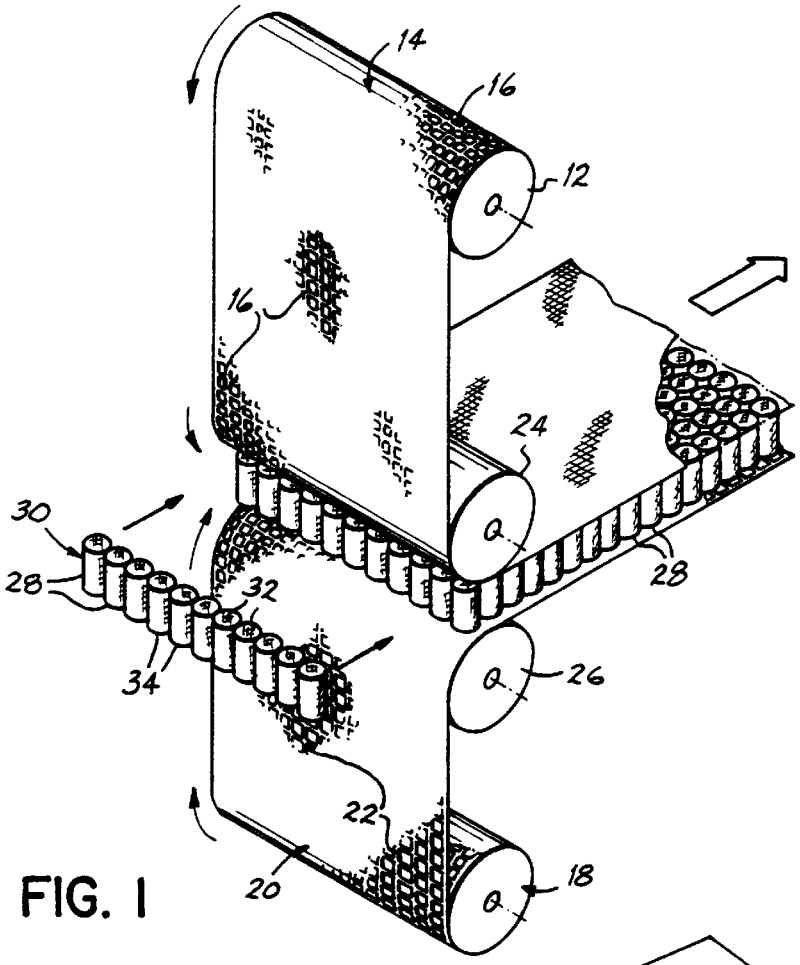
FIG. 1 is a schematic representation of a presently preferred embodiment of the method of the present invention and the product formed thereby.

Referring to the drawings, FIG. 1 illustrates a presently preferred method of assembling pocketed coil springs into cores for use in mattresses, cushions, seats or the like according to the principles of the present invention. As illustrated in FIG. 1, an upper supply roll 12 about which a first web of nonwoven fabric material 14 reinforced with a heat sensitive mesh netting 16 is disposed and a lower supply roll 18 carrying a second web of nonwoven material 20 also having a heat sensitive reinforcement mesh netting 22. The preferred nonwoven material with the reinforced netting is sold under the registered trademark LAMINET® by Conwed Plastics of Minneapolis, Minn. This product includes both the nonwoven material and the heat-actuated reinforcement, albeit the reinforced heat-actuated webbing itself is also sold by this company under the registered trademark THERMANET®. The heat sensitive reinforced mesh or netting is a polypropylene plastic with the adhesive integral with the netting itself so as to form both a bonding agent and a reinforcement for the nonwoven. Alternatively, the web having an adhesive or other bonding agent such as a polymer, plastic, polypropylene, ester, amine or the like, heat activated or otherwise activated, may be separate from a layer of reinforcing material and applied to the innerspring core with or without the reinforcing material according to this invention. Furthermore, the web of adhesive may be in an open mesh configuration or another known configuration within the scope of this invention. As used herein, the terms "web" and variations thereof refer to any sheet, membrane, plate, strip, net or laminar material or the like. Preferably, the web is supplied in a rolled configuration of a specified width covering the entire designed width of the innerspring core, although these are not requirements or limitations on the invention.

To be activated, the webs 14, 20, according to a presently preferred embodiment of this invention, may thus be heated and the adhesive has a tack temperature of approximately 180° F. to 212° F. and a melt temperature between 200° F. and 284° F.

Figure 2:
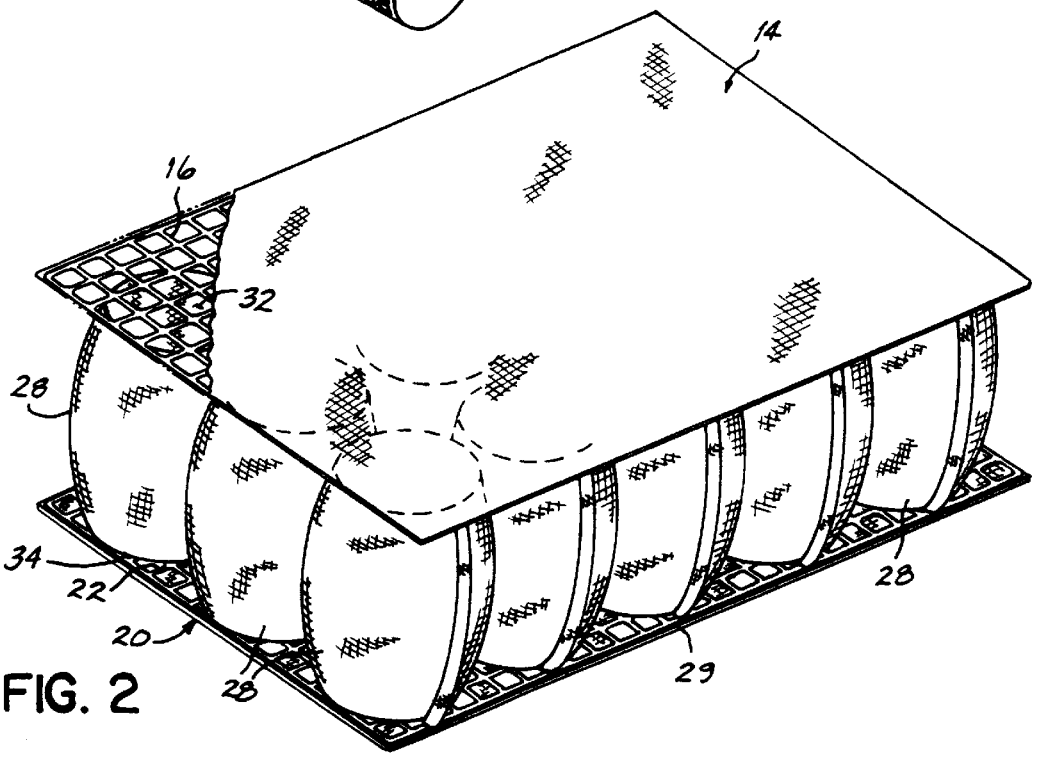
FIG. 2 is a perspective view of a fragment of the product made by the method of the present invention.
Figure 3:
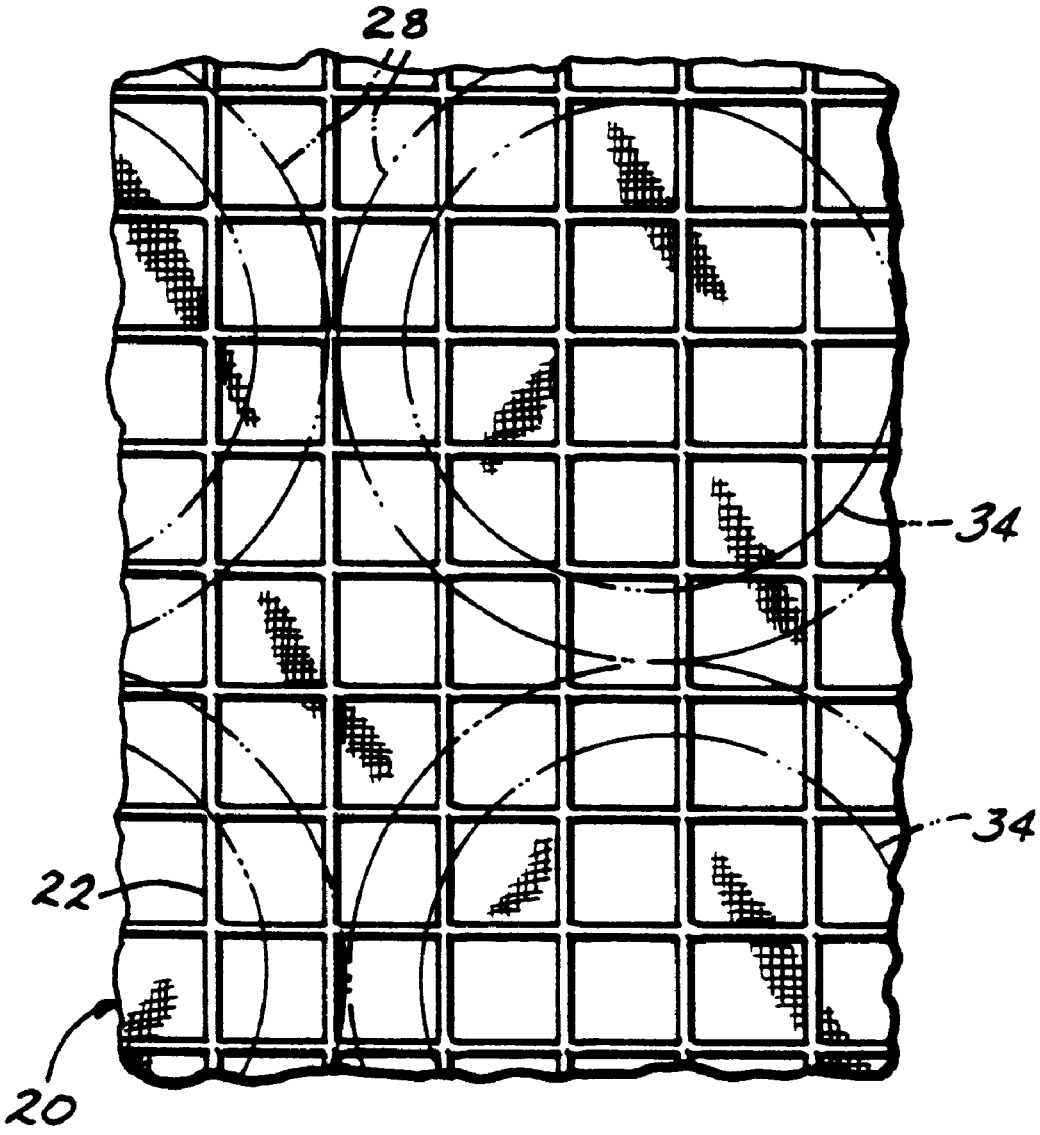
FIG. 3 is a plan view illustrating a portion of a web of nonwoven material and the heat sensitive adhesive netting with coil spring pockets superimposed thereon.

Thus, although the webs may be pushed against the surface of a hot bar, heated or activated in another manner, it is preferred that the webs 14, 20 be trained about respective upper and lower heated drums or rolls 24, 26 to activate the adhesive, the netting 16, 22 being disposed on the surface of the webbing remote from the surface of the respective rolls and thus face each other. The rolls 24, 26 are preferably spaced apart by a distance slightly less than the height of a pocketed coil spring 28 thereby compressing the spring 28. The pocketed springs are preferably premanufactured by insertion of a barrel shaped coil spring into a pocket or casing formed from nonwoven fabric material and sealed therein along two lateral edges, one of which is illustrated at 29 in FIG. 2, and an edge at the bottom by a heat melt glue as is well known in the art. A group of such pocketed coils may then be bonded together to form a string 30 of pocketed coils which are fed into the nip between the hot rollers 24, 26. The rollers 24, 26 thus apply a moderate nip pressure to the webs 14, 20 respectively against the tops 32 and bottom 34 nonwoven fabric material of the pocketed coils to activate the adhesive and bond the webs to the pocketed coil string. The process continues with a multiplicity of such strings 30 fed into the nip between the rolls 24, 26 in seriatim for either a finite desired length of a core or a continuous length from which cores of desired lengths may be severed.

Accordingly, the present invention provides a simple process that overcomes all of the aforesaid problems encountered in the prior art. Additionally, the process may be automated by automating the positioning of the strings of coils and the indexing of the strings into the nip between the heated rollers as will be readily apparent to one skilled in the art. The netting reinforced nonwoven material thus not only permits a strengthened innerspring core having pockets within which a coil is positioned, but permits the bonding of the webbing to the strings of coils in a manner not heretofore known in the prior art.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of assembling a plurality of pocketed coil strings into an inner spring core wherein each string comprises a plurality of side-by-side pockets containing coil springs of a finite height, each pocket being formed from a nonwoven material, said method comprising:

providing first and second continuous webs of nonwoven fabric material having a mesh netting with a heat activated adhesive on one surface;

feeding each of said webs into contact with a respective heating member to activate said adhesive;

spacing said heating members apart by a distance less than the height of said springs;

feeding said webs against the respective heating member with the netting facing away from the respective heating member and with the netting on said first web facing the netting on said second web; and feeding a pocketed coil string into the space between said heating members to engage opposite ends of said pockets with a respective web to bond a web to each of the pockets of said string and bond said webs to said pockets.

2. The method according to claim 1 further comprising:

repeating the step of feeding said string with other strings in seriatim as said webs are being fed to bond additional strings between said webs.

3. A method of assembling a plurality of pocketed coil strings into an innerspring coil wherein each string comprises a plurality of side-by-side pocket containing coil springs of a finite length, each pocket being formed from a nonwoven material, said method comprising:

providing first and second continuous webs of nonwoven fabric material having a mesh netting with a heat activated adhesive on one surface;

feeding each of said webs into engagement with a respective rotating heated roll;

spacing said rolls apart to define a nip between said rolls of a distance less than the height of said springs;

feeding said webs about the respective roll with the netting facing away from the respective roll and with the netting on said first web facing the netting on said second web; and feeding a pocketed coil string into the nip between said rolls to engage opposite ends of said pockets with a respective web to bond a web to each end of the pockets of said string and bond said webs to said pockets.

4. The method according to claim 3 further comprising:

repeating the step of feeding said string with other strings in seriatim as said webs are being fed to bond additional strings between said webs.

5. A method of assembling a plurality of strings of pocketed coil springs into an inner spring core wherein each string comprises a plurality of side-by-side pockets containing coil springs, said method comprising:

providing a web having a bonding agent, wherein the bonding agent is a heat activated adhesive;

applying the web to corresponding surfaces of a pair of strings of pocketed coil springs; and activating the bonding agent of the web to thereby join the strings of pocketed coil springs together by heating the web;

wherein the web is passed over a heated roller to heat the web and activate the adhesive prior to the web being applied to the strings.

6. The method of claim 5 wherein the web is applied to first end surfaces of the coiled springs of the strings.

7. The method of claim 6 further comprising:

providing a second web having a bonding agent;

applying the second web to corresponding second end surfaces of the strings of pocketed coil springs, the second end surfaces being spaced from the first end surfaces of the coiled springs; and activating the bonding agent on the second web.

8. The method of claim 5 further comprising:

compressing the springs in conjunction with applying the web to the strings.

9. The method of claim 5 further comprising:

applying a reinforced layer to the corresponding surfaces of the strings; and bonding the reinforced layer to the strings with the web.

10. The method of claim 9 wherein the applying of the reinforced layer and the applying of the web are accomplished simultaneously in that the reinforced layer and the web are integral.

11. A method of making a spring core comprising:

encasing a plurality of coiled springs in individual pockets to form a string of pocketed coil springs;

juxtaposing a plurality of the strings of pocketed coil springs in side-by-side relation with longitudinal axes of the springs being generally parallel to one another;

applying a web having a bonding agent to corresponding surfaces of the plurality of strings of pocketed coil springs, wherein the bonding agent is a heat activated adhesive; and activating the bonding agent on the web and thereby joining the strings of pocketed coil springs together by heating the web;

wherein the web is passed over a heated roller to heat the web and activate the adhesive prior to the web being applied to the strings.

12. The method of claim 11 wherein the web is applied to first end surfaces of the coiled springs of the strings.

13. The method of claim 12 further comprising:

providing a second web having bonding agent;

applying the second web to corresponding second end surfaces of the strings of pocketed coil springs, the second end surfaces being spaced from the first end surfaces of the coiled springs; and activating the bonding agent on the second web.

14. The method of claim 11 further comprising:

compressing the springs in conjunction with applying the web to the strings.

15. The method of claim 11 further comprising:

applying a reinforced layer to the corresponding surfaces of the strings; and bonding the reinforced layer to the strings with the web.

16. The method of claim 15 wherein the applying of the reinforced layer and the applying of the web are accomplished simultaneously in that the reinforced layer and the web are integral.

17. A method of making a spring core comprising:

encasing a plurality of coiled springs in individual pockets of nonwoven material to form a string of pocketed coil springs;

juxtaposing a plurality of the strings of pocketed coil springs in side-by-side relation with longitudinal axes of the springs being generally parallel to one another;

applying first and second webs each having a heat activated adhesive and a reinforced netting to corresponding first and second end surfaces, respectively, of the plurality of strings of pocketed coil springs; and heating the adhesive on the webs by passing the webs over heated rollers and thereby joining the strings of pocketed coil springs together.

18. The method of claim 17 further comprising:

compressing the springs in conjunction with applying the webs to the strings.

* * * * *